US008915350B2

(12) United States Patent
Tanner

(10) Patent No.: US 8,915,350 B2
(45) Date of Patent: Dec. 23, 2014

(54) METHOD AND DEVICE FOR DIVERTING A FLOW OF FLEXIBLE FLAT ITEMS

(75) Inventor: Roland Tanner, Grut (CH)

(73) Assignee: Ferag AG, Hinwil (CH)

( * ) Notice: Subject to any disclaimer, the term of this patent is extended or adjusted under 35 U.S.C. 154(b) by 144 days.

(21) Appl. No.: 13/511,485

(22) PCT Filed: Nov. 29, 2010

(86) PCT No.: PCT/CH2010/000302

§ 371 (c)(1),
(2), (4) Date: Jul. 31, 2012

(87) PCT Pub. No.: WO2011/066665

PCT Pub. Date: Jun. 9, 2011

(65) Prior Publication Data

US 2012/0285798 A1 Nov. 15, 2012

(30) Foreign Application Priority Data

Dec. 2, 2009 (CH) ..... 1850/09

(51) Int. Cl.
*B65G 47/244* (2006.01)
*B65H 29/00* (2006.01)
*B65H 29/66* (2006.01)

(52) U.S. Cl.
CPC ..... *B65H 29/00* (2013.01); *B65H 2301/321* (2013.01); *B65H 2301/34112* (2013.01); *B65H 2301/3422* (2013.01); *B65H 2404/111* (2013.01); *B65H 2301/44712* (2013.01); *B65H 2301/33214* (2013.01); *B65H 29/6627* (2013.01); *B65H 2301/4451* (2013.01); *B65H 29/6609* (2013.01)
USPC ..... 198/411

(58) Field of Classification Search
USPC ..... 198/462.2; 271/2
See application file for complete search history.

(56) References Cited

U.S. PATENT DOCUMENTS

| | | | | |
|---|---|---|---|---|
| 5,415,385 | A * | 5/1995 | Newsome et al. | 270/58.25 |
| 5,421,699 | A * | 6/1995 | Guiles et al. | 414/788 |
| 6,234,468 | B1 * | 5/2001 | Janatka et al. | 271/2 |
| 6,702,100 | B2 * | 3/2004 | Studer | 198/470.1 |
| 6,746,009 | B2 * | 6/2004 | Engarto et al. | 271/2 |
| 7,029,002 | B2 * | 4/2006 | Engarto et al. | 271/2 |

(Continued)

FOREIGN PATENT DOCUMENTS

| | | |
|---|---|---|
| DE | 109596 | 11/1974 |
| EP | 0900757 | 3/1999 |

(Continued)

*Primary Examiner* — Ramya Burgess
*Assistant Examiner* — Thomas Randazzo
(74) *Attorney, Agent, or Firm* — Rankin, Hill & Clark LLP

(57) ABSTRACT

A device and a method for rearranging flexible flat items, in particular printed products, which are delivered continuously in a delivery flow, relative to the delivery direction of the delivery flow. The items are delivered in an incoming delivery flow in a first delivery direction and with substantially identical orientation of the surface normals thereof, and in a predetermined cycle, to a diverting region. There, the delivery in the first delivery direction is ended and the individual items are accelerated in a second delivery direction, which is perpendicular to the first delivery direction and to the orientation of the surface normals in the incoming delivery flow, by an acceleration element which acts on the items in the diverting region in a predetermined cycle. The delivery flow moving in the second delivery direction is subsequently diverted.

18 Claims, 10 Drawing Sheets

(56) References Cited

U.S. PATENT DOCUMENTS

| | | | | |
|---|---|---|---|---|
| 7,178,800 | B2 * | 2/2007 | Stauber | 271/189 |
| 7,431,280 | B2 * | 10/2008 | Stauber et al. | 271/9.13 |
| 7,588,238 | B2 * | 9/2009 | Walther | 270/52.16 |
| 2007/0023998 | A1 * | 2/2007 | Walther | 271/265.01 |
| 2009/0189331 | A1 * | 7/2009 | Honegger | 271/10.01 |
| 2010/0025189 | A1 * | 2/2010 | Muller | 198/418.1 |

FOREIGN PATENT DOCUMENTS

| | | |
|---|---|---|
| EP | 1748012 | 1/2007 |
| JP | 61075449 | 5/1986 |
| JP | 1081743 | 3/1989 |
| JP | 3172269 | 7/1991 |
| JP | 5116403 | 5/1993 |
| JP | 5270745 | 10/1993 |

* cited by examiner

METHOD AND DEVICE FOR DIVERTING A FLOW OF FLEXIBLE FLAT ITEMS

BACKGROUND OF THE INVENTION

1. Field of the Invention

The invention lies in the field of conveying technology and relates to an apparatus and a method by means of which a conveying stream of flexible flat articles, in particular printed products, is shifted. Shifting is understood to mean the position of the articles, or at least one of the edges thereof, being changed relative to the conveying direction of the conveying stream.

2. Description of Related Art

In printing technology, but also in other fields, articles, e.g. printed products, are often conveyed in a conveying stream continuously one behind the other between various processing stations. The position of the articles in relation to the conveying direction and/or the orientation in space upon leaving a first processing station in this case frequently does not correspond to the position which is necessary for further processing. For example, printed products often leave a folding station in a product stream in which the folded edges are oriented in the conveying direction and in which the products are upright. For further processing, however, it is desirable to have a product stream in which the folded edges are oriented transversely to the conveying direction and in which the products are lying down. In order to achieve this shifting, use is made, for example, of intermediate conveyors which, in the first instance, set down the upright product stream, i.e. rotate it through 90° about an axis running in the conveying direction. Then, the articles are set down in a separated state on a conveying belt running transversely to the original conveying direction. This is described, for example, in U.S. Pat. No. 7,458,926 or in Swiss Patent Application No. 1209/09, which was not published before the priority date.

CH 617 408, EP-B 1375 404 or EP-B 1 318 095 discloses apparatuses by means of which the conveying direction of an imbricated formation of printed products which is conveyed in a lying-down state can be rotated through 90°, while maintaining the horizontal conveying plane. For this purpose, the articles are conveyed against a stop, as a result of which the movement in the original conveying direction of these articles is stopped. In the region of the stop, the articles are subjected to the influence of a removal conveyor, which conveys transversely to the original conveying direction. Therefore, the product stream, deflected through 90°, will maintain the imbricated formation. The orientation of a predetermined product edge, however, changes relative to the conveying direction. Since the imbricated formation has not broken up in the meantime, the possible uses of such apparatuses are limited. In particular it is not possible for any imbricated stream of products folded one inside the other to be converted into an imbricated stream of products located one on top of the other.

EP-A 0 900 757 discloses a deflecting apparatus by means of which a stream of individually conveyed printed products which leave the exit of a folding former individually in the vertical direction is converted into an imbricated stream conveyed in the horizontal direction. There is no change here, however, in the orientation of the folded edge relative to the conveying direction. This apparatus is not suitable, in particular, for folding installations which fold an imbricated stream which is conveyed in a folding direction.

The disadvantage with the known shifting apparatuses and methods in which it is intended to change the product position in space and the orientation of a certain edge relative to the conveying direction is that a comparatively large amount of space is required. The installation according to U.S. Pat. No. 7,458,926 or Swiss Patent Application No. 1209/09 requires a distance of 1 to 1.5 m, for example, in order for the product stream, which is conveyed in an upright state in the first instance, to be set down laterally.

More compact installations provide for the formation of intermediate stacks. The intermediate stacks are broken up in a suitable manner, and therefore the articles in the resulting conveying stream have the appropriate orientation. However, the articles here have to be fully braked and accelerated again. Continuous processing is not possible.

BRIEF SUMMARY OF THE INVENTION

It is therefore an object of the invention to specify an apparatus and a method which are intended for shifting a continuously moving conveying stream and in the case of which the outlined disadvantages are avoided and continuous conveying is possible. In particular it should be possible to achieve, by straightforward means, a change in the position of a predetermined article edge relative to the conveying direction and a change in the orientation of the articles in space.

The method comprises the following steps, wherein the surface normals of the articles at any point in time are oriented essentially perpendicularly to the current conveying direction:

- the articles in an ingoing conveying stream are conveyed in a first conveying direction, and with a first orientation of the surface normals thereof, and with predetermined cyclic timing to a deflecting region.
- The conveying action in the first conveying direction is terminated and individual articles are accelerated in a second conveying direction, which is directed perpendicularly to the first conveying direction and to the first orientation of the surface normals in the ingoing conveying stream, by an accelerating element, which acts on the articles with predetermined cyclic timing in the deflecting region.
- The conveying stream moving in the second conveying direction is deflected, in the deflecting region, into a third conveying direction, which is perpendicular to the first conveying direction and encloses an angle other than zero (in particular greater than 45°, preferably approximately 90° or approximately 180°) with the second conveying direction, and the articles are conveyed further, after leaving the deflecting region, in an outgoing conveying stream.

The method according to the invention gives rise to a straightforward change in position of any desired edge of an article, e.g. the folded edge, relative to the conveying direction. This corresponds to a change in formation between the ingoing and the outgoing formations. The additional deflection into the third conveying direction also makes it possible to adapt the orientation of the surface normals in space in order to achieve an optimum position for further processing, e.g. further conveyance in a lying-down state as an imbricated formation or transfer of individual articles to grippers.

The method according to the invention, in particular the termination of the conveying action in a first conveying direction and the preferably simultaneous acceleration in a second conveying direction, which runs perpendicularly to the first, can be implemented in a very small amount of space. In principle, a sufficient deflecting region for this purpose is one which has a dimension in the first conveying direction which is somewhat greater than a typical article length. Further deflection into the third conveying direction also takes place in this deflecting region. Since the articles are accessed in cyclically timed fashion in the deflecting region, it is possible for these articles, even in the case of high conveying speeds in the ingoing formation, to be accelerated very precisely, and without any adverse effects, and even to be separated if required. This is not the case with the apparatuses mentioned in the introduction. Termination of the conveying action in the first conveying direction preferably takes place by the articles being pulled out individually from the conveying stream, and accelerated in the second conveying direction, by the accelerating element. It is therefore possible to dispense with a stop or any other deflecting element against which the articles run and by means of which these articles are deflected from their original movement direction. The conveying path in the first conveying direction is therefore preferably not bounded by a stop or any other deflecting element.

The apparatus according to the invention comprises the following components:

- an entrance, at which a conveying stream which goes in cyclically timed fashion is fed in a first conveying direction, and with an orientation of the surface normals of the articles perpendicular to the first conveying direction. An entrance conveyor may be positioned upstream of the entrance. The entrance is preferably not bounded in the first conveying direction by an element acting as a stop.
- At least one accelerating element, which is able to act on the articles with predetermined cyclic timing and thus to accelerate the same in a second conveying direction, wherein the second conveying direction is directed perpendicularly to the first conveying direction and to the orientation of the surface normals in the ingoing conveying stream. The accelerating element is also able to suppress the further movement of the articles in the first conveying direction, e.g. by pulling the articles away from any elements which provide for conveying action in the first conveying direction.
- An exit, at which an outgoing conveying stream is discharged. The exit may have positioned downstream of it an exit conveyor, which receives the articles from the exit. A further change in formation can take place here.
- An intermediate conveyor, which is arranged between the entrance and exit and is able to receive, and convey further, the articles following, or during, acceleration by the accelerating element. The intermediate conveyor defines a curved conveying path for the articles which is oriented on the entrance side in the second conveying direction and on the exit side in a third conveying direction, which is perpendicular to the first conveying direction and encloses an angle other than zero with the second conveying direction.

According to the invention, the orientation of a certain article edge, e.g. of the fold region in the case of folded, adhesively bonded or otherwise bound printed products, in space always remains the same. Shifting is achieved by changing the conveying direction and changing the orientation of the surface normals in space. The articles may optionally be separated in addition. The method and apparatus can be used very flexibly for shifting various different formations: the ingoing conveying stream may be a stream of spaced-apart individual articles or an imbricated stream in which the spacing between the leading edges of the articles is smaller than the length of the articles as measured in the first conveying direction. In the case of an imbricated stream, the articles may be located partially one upon the other. However, the imbricated formation may also be one made up of articles arranged one inside the other, if, for example, folded, adhesively bonded or otherwise bound printed products are being conveyed. It is likewise possible for the articles to be present individually or as an imbricated formation in the outgoing conveying stream. In the case of the ingoing and outgoing imbricated formations, it is possible for the positions of the main surfaces (e.g. front page and back page) of adjacent articles to change in relation to one another or to remain the same. For example, the (current) leading edge rests on the front page in the ingoing and outgoing imbricated formations (no change in position of the main surfaces) or is located on the front page in the ingoing formation and on the back page in the outgoing formation (change in position of the main surfaces). In the case of no change in position, there is also no need for any separation in the shifting region, although it is possible. Subsequent transfer into an individual conveying means, e.g. into grippers of a gripper conveyor, is possible.

The invention has particular advantages in conjunction with the folding installation mentioned in the introduction: the printed products leave the folding station in an imbricated stream in which the folded edges are oriented in the customarily horizontal conveying direction and in which the products are arranged one inside the other and are upright, i.e. have horizontally oriented surface normals. It is desirable for further processing, however, to have a conveying stream in which the folded edges of the printed products are leading in relation to the conveying direction and rest on the respectively preceding product. The apparatus according to the invention pulls the products upward or downward (second conveying direction) out of such an ingoing conveying stream, separates the same here and deflects the resulting stream again into a horizontal or obliquely upwardly running third conveying direction. The amount of space required is considerably reduced in relation to installations which first of all set down the imbricated stream laterally, then separate it in a first conveying direction and subsequently generate a new, transversely conveyed imbricated formation.

The outgoing conveying stream can be transferred onto a belt conveyor which conveys the articles further preferably with essentially vertical orientation of their surface normals. As an alternative, or following the belt conveyor, it is possible to provide a gripper conveyor which conveys the articles further with essentially horizontal orientation of their surface normals, that is to say they are conveyed further in a hanging state.

The accelerating element may be designed, for example, as a component which is able to act on the surface of the printed products, and deflect them into another conveying direction, by transmission of a movement pulse. This other conveying direction may be located, for example, perpendicularly to the conveying direction in which the printed products are fed. The accelerating element may be, for example, a knock-off element.

BRIEF DESCRIPTION OF THE DRAWINGS

Examples of the invention are described hereinbelow and illustrated in the drawings, in which, purely schematically.

DETAILED DESCRIPTION OF THE INVENTION

Figure 1A:
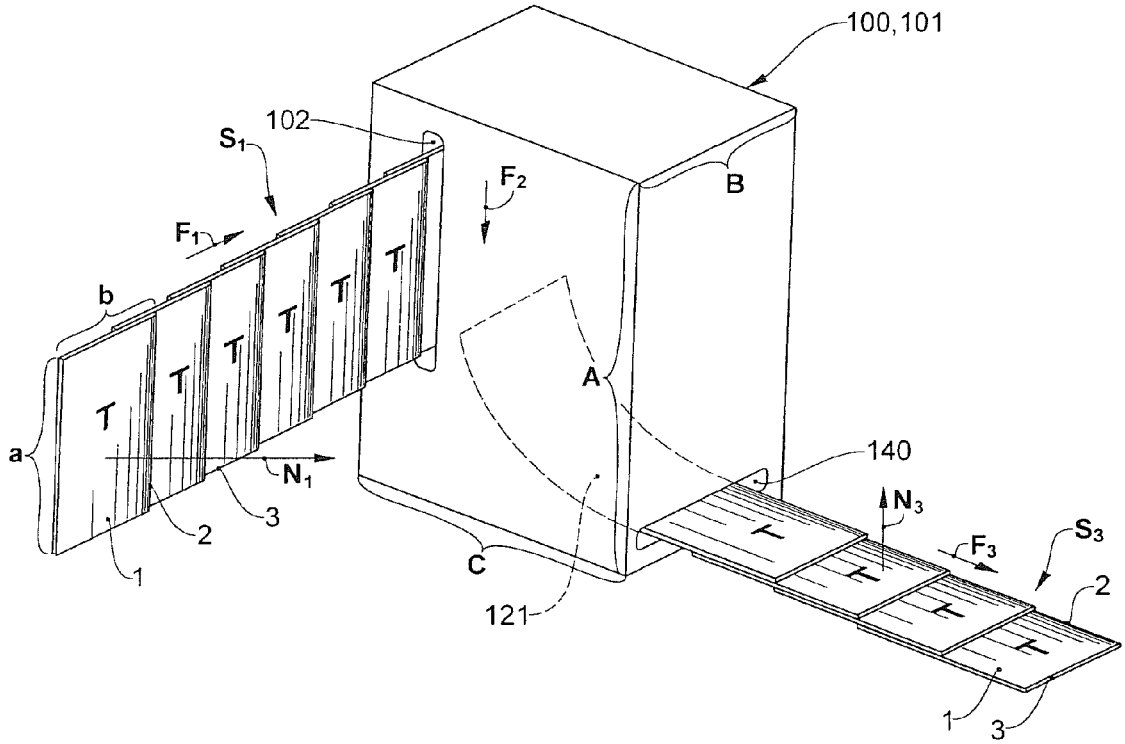
FIGS. 1 *a-d* show examples of conveying streams which go in an upright state and go out in a lying-down state.

FIGS. 1 *a-d* and 2 show examples of ingoing and outgoing conveying streams S1, S3 which run through a shifting apparatus 100 according to the invention, which is illustrated as a "black box". This shifting apparatus defines a deflecting region 101. The ingoing conveying stream 51 is conveyed in each case in a horizontal, first conveying direction F1 to the entrance 102 of the shifting apparatus 100.

In FIGS. 1*a-d*, the articles 1 in the ingoing conveying stream S1 are upright (horizontal surface normal N1). The outgoing conveying stream S3 leaves the exit 140 of the shifting apparatus 100 in a horizontal, third conveying direction F3, wherein the articles 1 are lying down (vertical surface normal N3). Within the shifting apparatus 100, the articles run through a curved conveying path 121 which on the entrance side is oriented perpendicularly to the original conveying direction F1 (second conveying direction F2) and on the exit side runs in the third conveying direction F3. The orientation of a marked edge 2, which in this case is, for example, the folded edge, is changed relative to the conveying direction F1 or F3 by the shifting apparatus 100: in the ingoing stream S1, the edge 2 is leading; in the outgoing stream S3, the edge 2 is oriented in the current conveying direction F3. Furthermore, there is rotation of the orientation of the surface normals N1, N3 in space.

In the case of FIG. 1*a*, a formation S1 going in is one in which the front pages, designated by T, are oriented to the right in the ingoing stream S1. The leading edges (folded edges 2) rest on the front page T of the preceding article 1. The articles 1 are pulled out downward (conveying direction F2) and are then deflected into a horizontal position by rotation through 90° counter-clockwise about the first conveying direction F1. In the outgoing conveying stream S3, the front pages T are oriented upward and the originally downwardly oriented side edges 3 are oriented in the forward direction. The edges 3, moreover, rest on the preceding article 1. The front page and rear page of adjacent articles 1 thus do not change their position relative to one another (back page of one article is in contact with the front page of the preceding article). Articles can, but need not, be separated within the shifting apparatus 100 in order to generate the outgoing conveying stream S3 shown here.

Figure 1B:
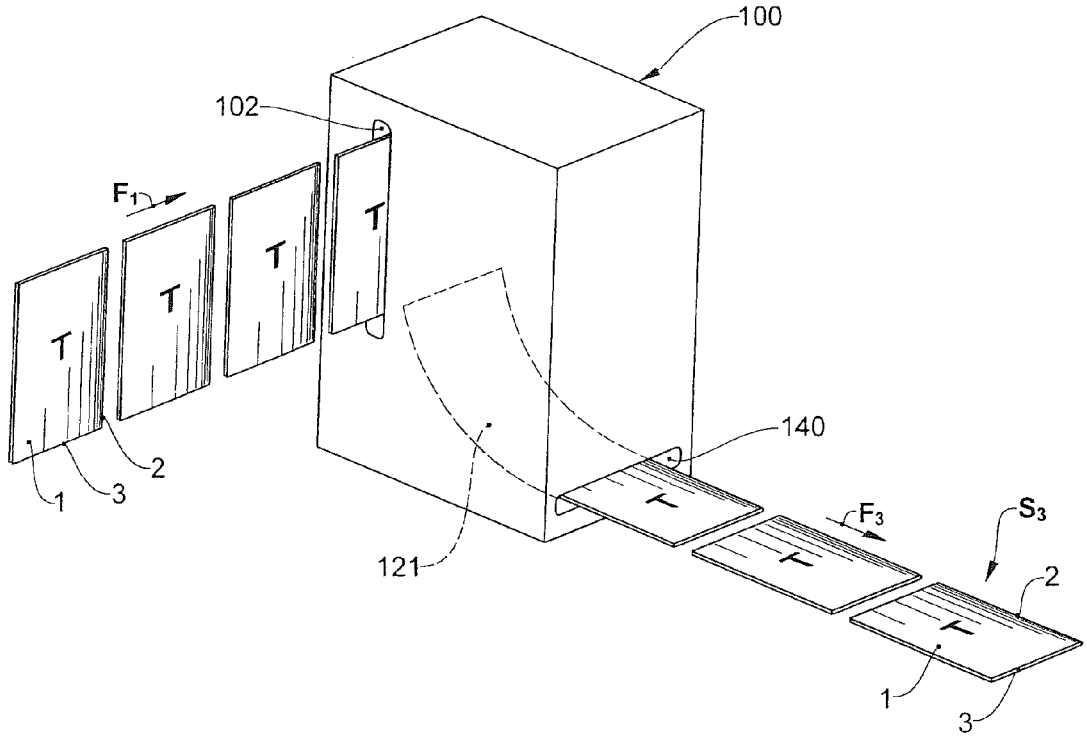

In the case of FIG. 1*b*, the ingoing formation S1 comprises individual articles. As in the case of FIG. 1*a*, the front pages T are oriented to the right and the folded edges 2 are the leading edges. In the outgoing formation S3, the side edges 3, originally located at the bottom, are the leading edges. Here too, the articles 1 have been separated into individual articles. The articles 1 can be conveyed in the separated state within the shifting apparatus 100 in order to generate the outgoing conveying stream S3 shown here. It is also possible, however, for them to run through the shifting apparatus 100 with a mutual overlap and be separated again for the first time at the exit 140, by suitable selection of the conveying speed of the removal conveyor.

Figure 1C:
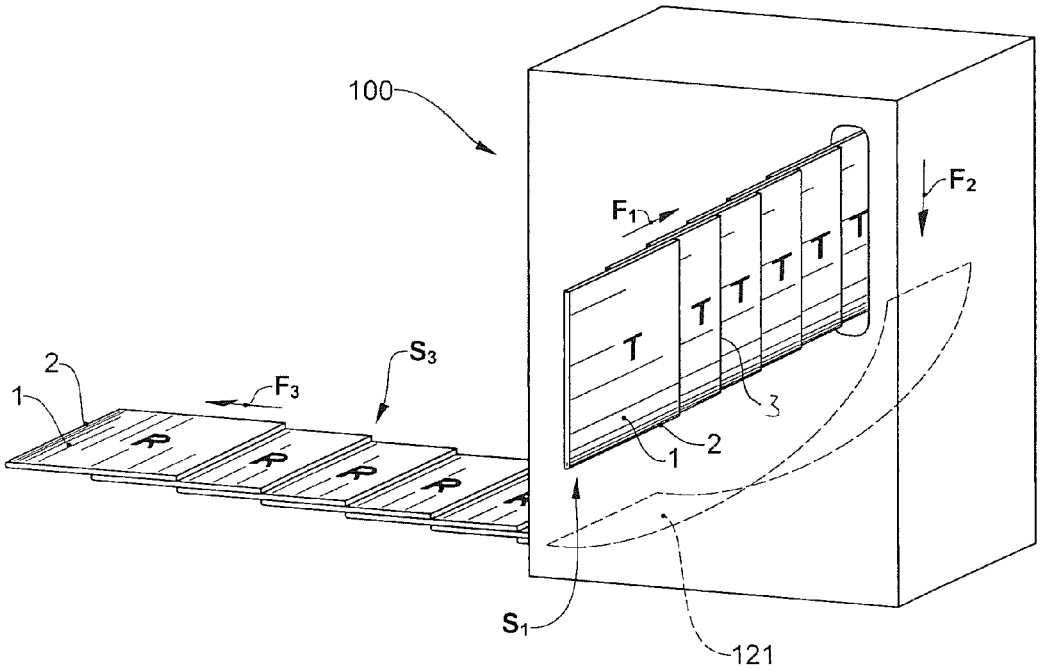

In the case of FIG. 1*c*, the front pages T, once again, are oriented to the right. The folded edges 2 are the lower edges. In the ingoing conveying stream S1, they are oriented in the first conveying direction F1. A side edge 3 forms the leading edge, which rests on the front page T of the preceding article 1. Within the shifting apparatus 100, the articles 1 rotate in the clockwise direction about the first conveying direction F1. In the outgoing conveying stream S3, the back pages, designated by R (and on the left in the ingoing stream S1), are thus located at the top. In the outgoing conveying stream S3, the folded edges 2 are oriented transversely to the third conveying direction F3. They are located in each case beneath the preceding article 1. It is also possible in this example for the articles to be separated within the shifting apparatus 100. This is not imperative, however, since the position of adjacent articles 1 relative to one another is not changed (back page of one article is in contact with the front page of the preceding article).

Figure 1D:
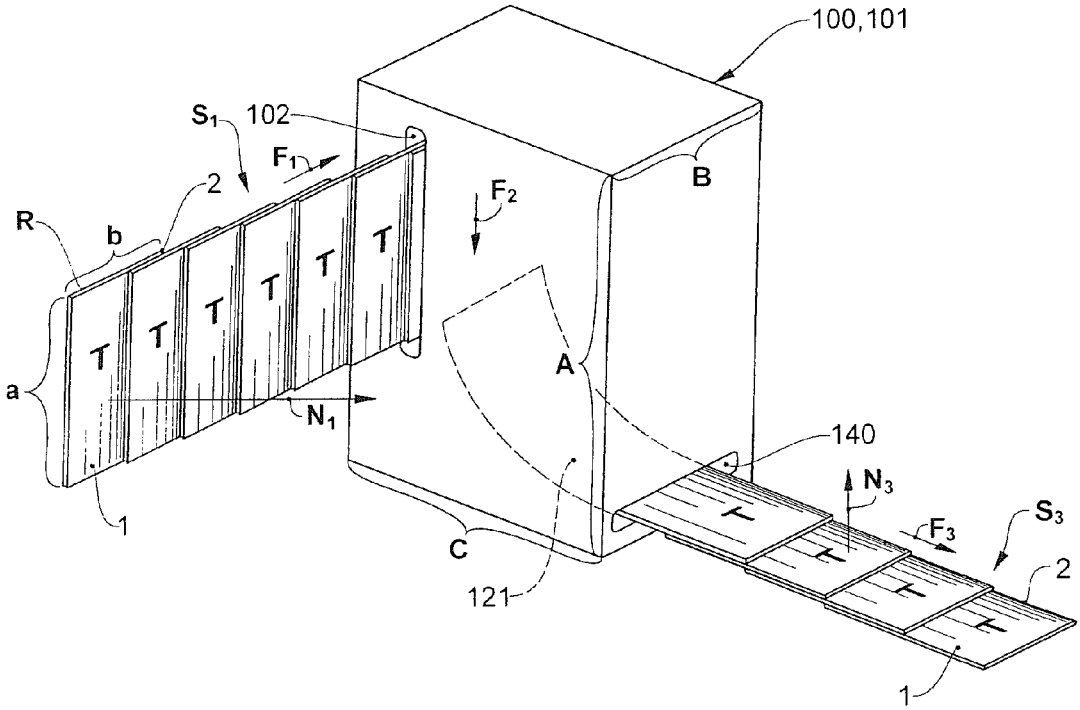

In the case of FIG. 1*d*, a formation S1 going in is one in which the front pages, which are designated by T, are oriented to the right in the incoming stream S1. In contrast to FIG. 1*a*, the leading edges (folded edges 2) rest on the back page R of the preceding article 1. As in the case of FIG. 1*a*, the articles 1 are pulled out downward (conveying direction F2) and then deflected into the horizontal position by rotation through 90° counter-clockwise about the first conveying direction F1. In the outgoing conveying stream S3, the front pages T are oriented upward and the originally downwardly oriented side edges 3 are oriented in the forward direction. The edges 3, moreover, rest on the preceding article 1. The front page and back page of adjacent articles 1 therefore change their position relative to one another (front page of one article is in contact with the back page of the preceding article in the ingoing stream; back page of one article is in contact with the front page of the preceding article in the outgoing stream). It is, thus, necessary to separate the articles within the shifting apparatus 100 in order to generate the outgoing conveying stream S3 shown here.

Depending on the conveying speeds in the feed means, the removal means and in the shifting apparatus 100, it is also possible to convert an imbricated stream into individual articles and vice versa.

The deflecting region 101 may be very compact: the articles 1 are pulled vertically downward out of the ingoing conveying stream S1 in the shifting apparatus 100. If a is that width of the largest processable format of the articles 1 as measured transversely to the first conveying direction F1, and b is that length of the largest processable format of the articles 1 as measured in the first conveying direction F1, there is no need for the length B of the deflecting region 101, in relation to the first conveying direction F1, to be significantly greater than b. The height A of the deflecting region 101 corresponds approximately to the product width a plus a distance which is necessary for pulling articles out in the second conveying direction F2. The height A is typically smaller than four times the width a and, in the case of appropriate flexibility of the articles, may even be smaller than double the width a. The width C of the deflecting region 101 is determined from the desired orientation of the third conveying direction F3 and the flexibility of the articles 1.

Figure 2:
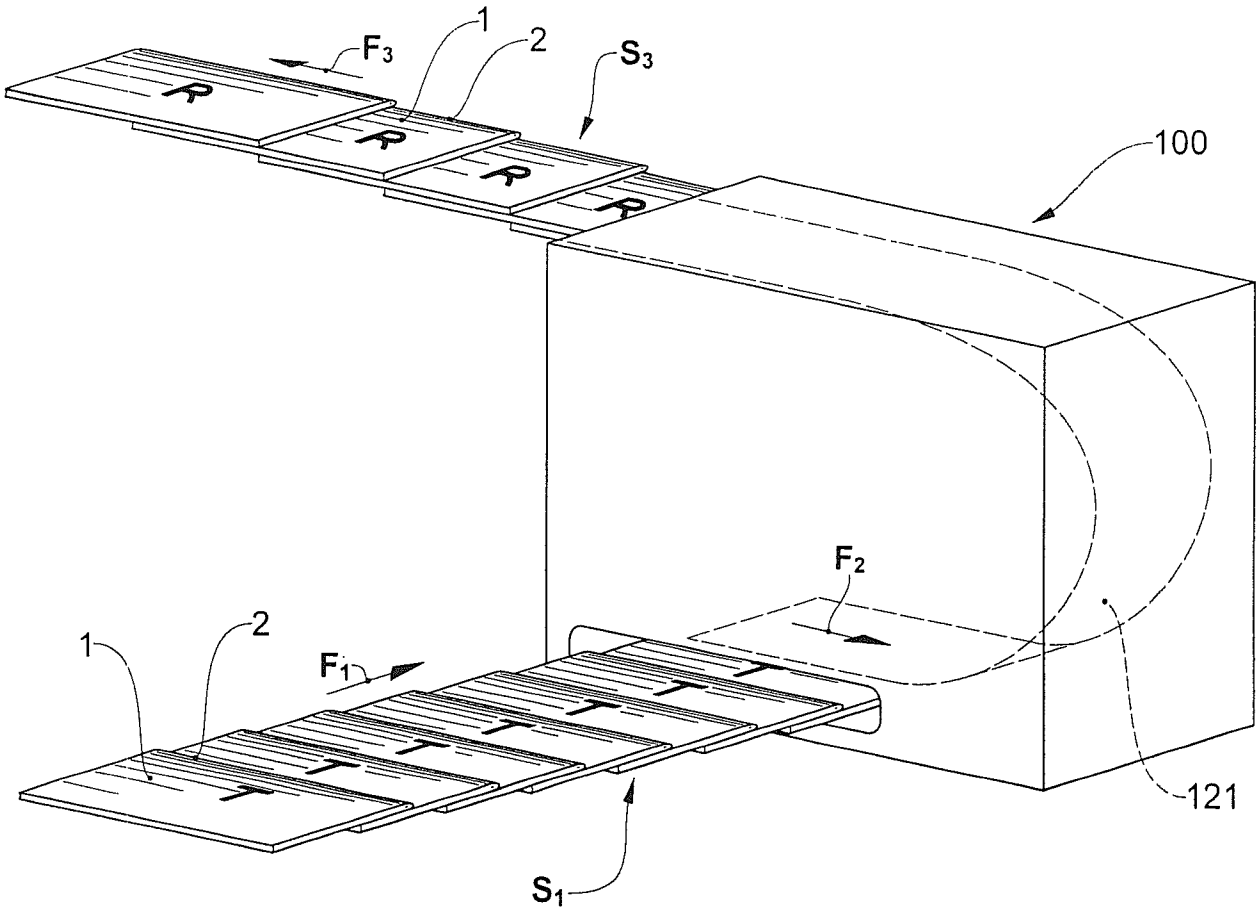
FIG. 2 shows an example of a conveying stream which goes in a lying-down state and goes out in a lying-down state.
Figure 3:
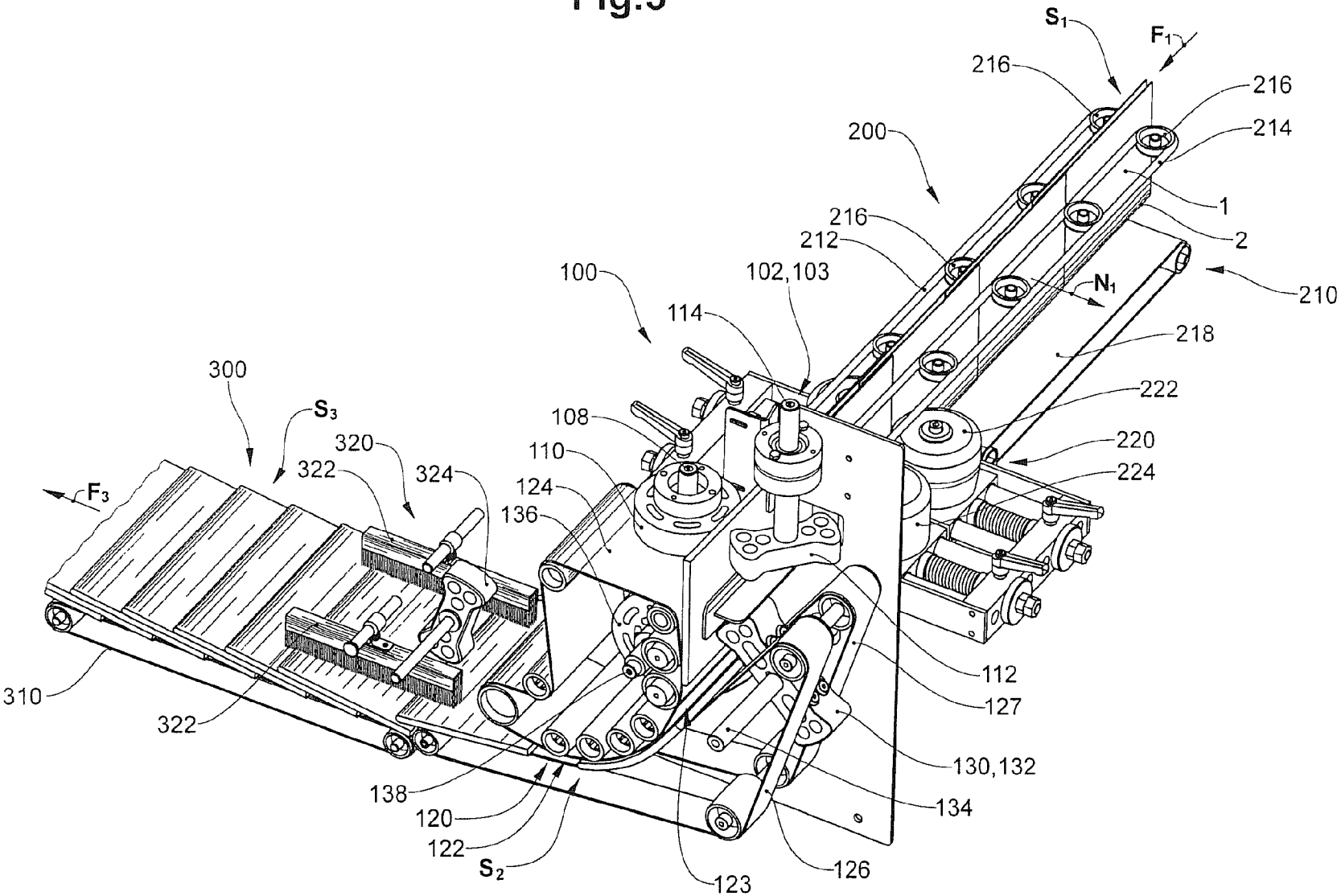
FIGS. 3+4 show perspective views, from two different viewing directions, of a shifting apparatus during the operation of shifting imbricated streams.
Figure 4:
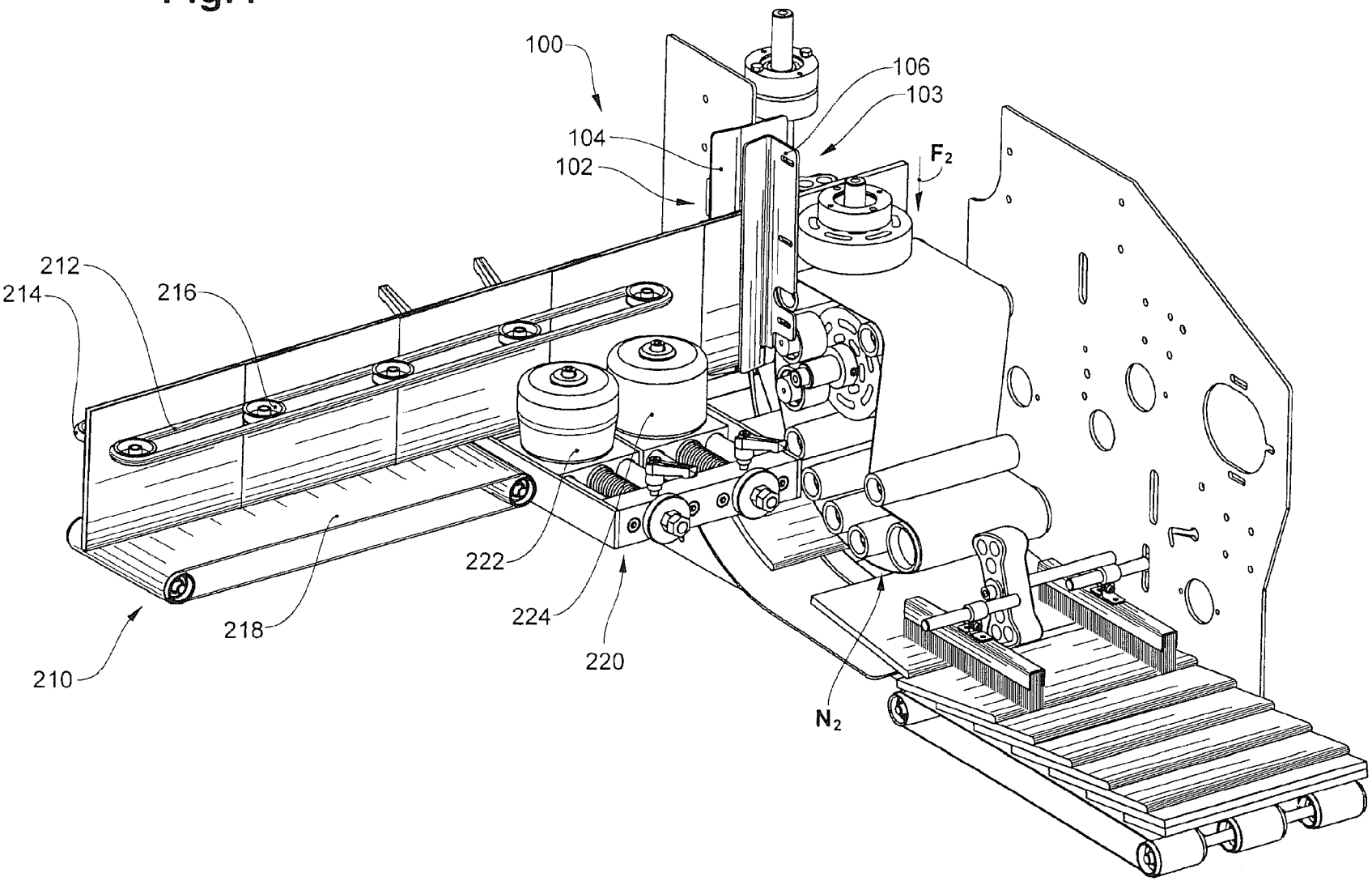
Figure 5:
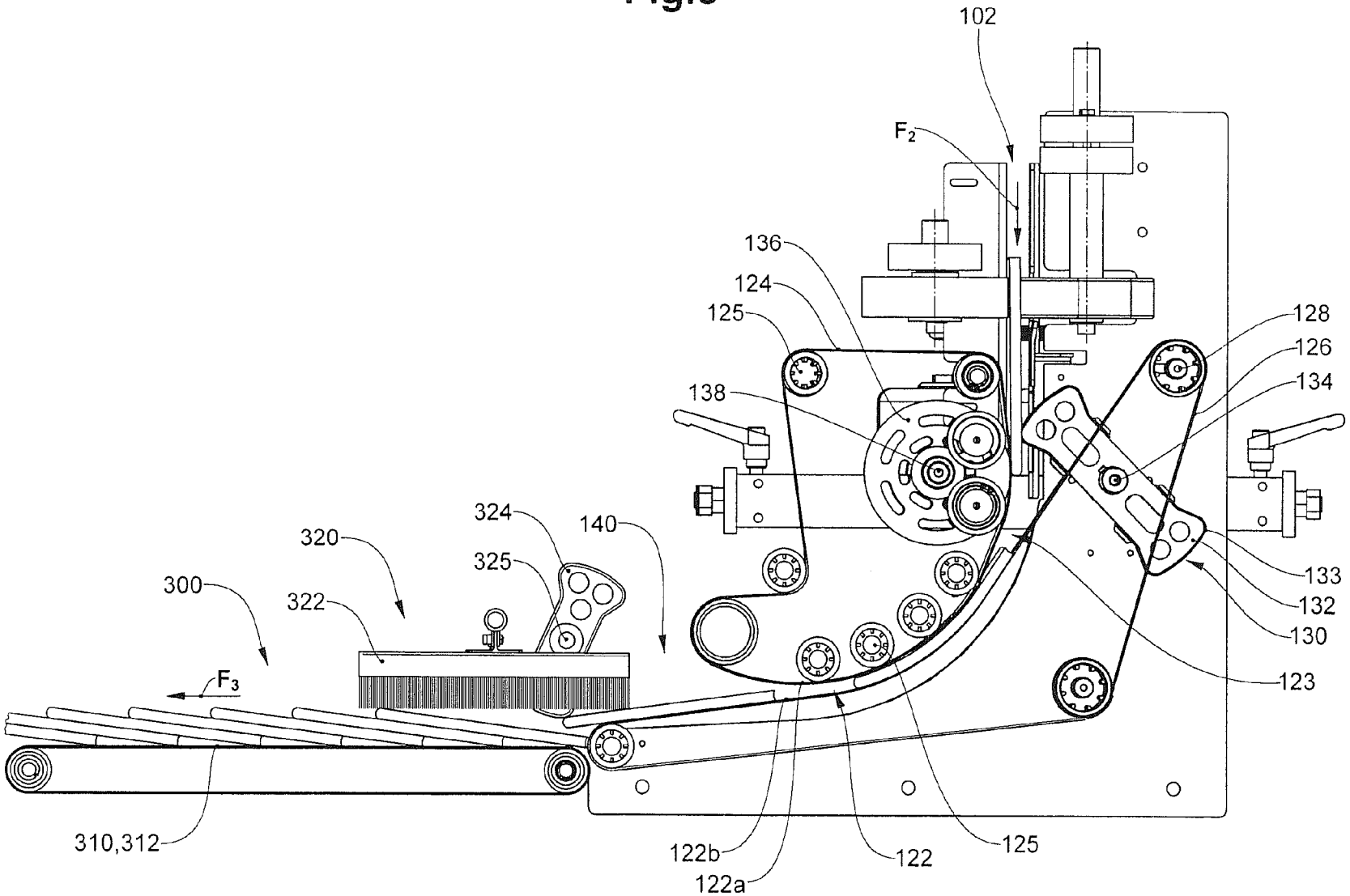
FIGS. 5+6 show a view from the side and a view from above, respectively, of the apparatus from FIGS. 1+2.
Figure 6:
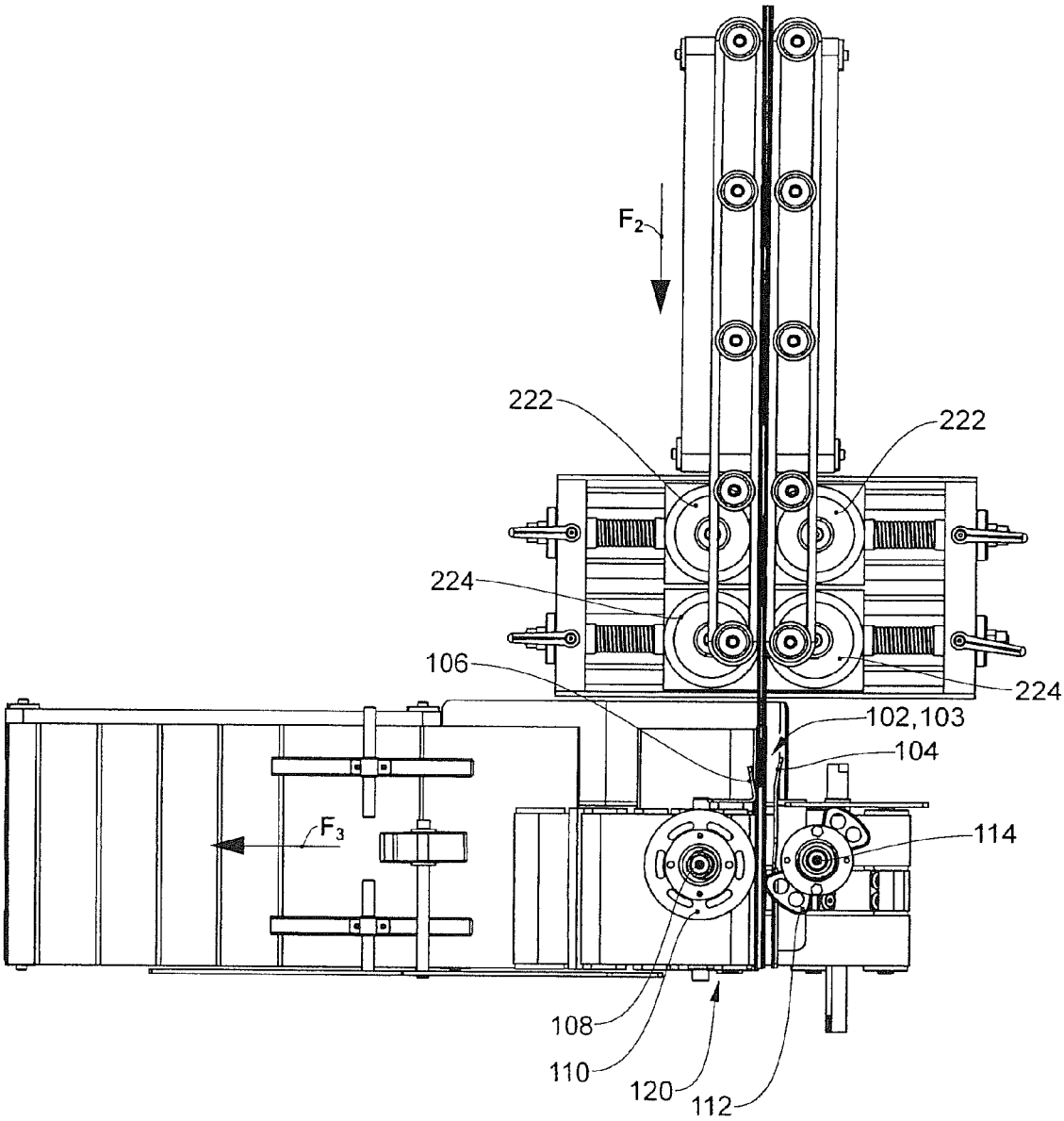

FIG. 2 shows, schematically, how a horizontally ingoing lying-down imbricated formation S1, by lateral acceleration in the horizontal direction F2 and deflection through 180°, can give rise, once again, to a horizontally outgoing lying-down imbricated formation S3. In this figure, the positions of the front page and back page T, R have been reversed. Furthermore, a marked edge 2 has changed its orientation in relation to the current conveying direction F1, F3.

FIGS. 3-6 show various views of a shifting apparatus 100 according to the invention. The shifting apparatus 100 has an entrance module 200 positioned upstream of it and an exit module 300 positioned downstream of it. The entrance module 200 comprises an entrance conveyor 210, for conveying upright articles 1 in an in this case horizontal, first conveying direction F1, and a folding station 220. The exit module 300 comprises an exit conveyor 310, for conveying lying-down articles 1 in an in this case horizontal, third conveying direction F3, and a positioning device 320.

The entrance conveyor 210 conveys flat, flexible articles 1 in a cyclically timed ingoing conveying stream S1 in the first conveying direction F1 to the folding station 220 and then to the entrance 102 of the shifting apparatus 100. For this purpose, the entrance conveyor 210 comprises at least one pair of belts 212, 214, which are driven in opposite directions and are guided over deflecting rollers 216 in the horizontal direction. A conveying belt 218, which is driven synchronously with the belts 212, 214, is located beneath the belts 212, 214. This conveying belt supports the articles on their downwardly oriented edges, in this case the folded edges 2, while the belts 212, 214 guide the articles in the upper region and convey the same. The conveying belt 218 terminates upstream of the folding station 220, and the belts 212, 214 lead up to the entrance 102 of the shifting apparatus 100. The folding station 220 comprises, in a manner known per se, two pairs of folding rollers 222, 224, which are spring-mounted in opposite directions to one another and have their lateral surfaces running conically or in rectilinear fashion.

The articles 1 here are folded printed products which are conveyed in an upright state, i.e. with a horizontal surface normal N1, in the ingoing conveying stream S1. The ingoing conveying stream S1 is an imbricated stream of articles 1 folded one inside the other, wherein the folded edge 2 is oriented in the first conveying direction F1 and wherein part of each article is located in the preceding article.

By means of stationary guide elements 104, 106, in this case guide plates, the entrance 102 of the shifting apparatus 100 forms a vertical inlet gap 103 for the flat articles 1. In the upper region of the inlet gap 103, a guide roller 110, which can be rotated about a vertical spindle 108, is arranged on one side. This guide roller interacts with a drivable segment plate 112 on the other side of the inlet gap 103, it being possible for this segment plate to be rotated about a likewise vertical spindle 114. Depending on the position of the segment plate 112, the inlet gap 103 is narrowed or open in the upper region. The segment plate 112 serves, together with the passive guide roller 110, for receiving the articles 1 from the entrance conveyor 210 and for conveying them further in the first conveying direction F1. This conveying action continues only as long as the segment plate 112 and guide roller 110 act together on the article and thus retain the same. Instead of an active conveying action, it is also possible to provide for purely passive guidance, e.g. by use being made of stationary guide plates instead of the driven segment plate. Movement in the first conveying direction then takes place on account of mass inertia. The guide roller 110 may be inherently elastic and/or consist of an elastic material. It is not necessary for the segment plate 112 and guide roller 110 to provide for active braking or acceleration of the articles 1.

An accelerating element 130 and an intermediate conveyor 120 are located beneath the arrangement of segment plate 112 and guide roller 110. The accelerating element 130 here is likewise a segment plate 132, which can be driven about a vertical spindle 134. By means of this segment plate, the articles 1 located in the inlet gap 103 are accelerated in a second conveying direction F2, in this case downward, and possibly separated in the process. The accelerating element 130 accesses the front region of the articles 1, as seen in the conveying direction F1, in which the article 1, even in the case of an ingoing imbricated formation, does not have any overlap with the following article. The article 1 is thus pulled out downward. It does not run against a stop.

The intermediate conveyor 120 serves for deflecting the articles 1 from the second conveying direction F2 into the third conveying direction F3, which in this case is horizontal again. The intermediate conveyor 120 forms an at least partially curved conveying gap 122. The latter is oriented on the entrance side in the second conveying direction F2 and at the exit 140 of the deflecting apparatus 100 in the third conveying direction F3, that is to say it describes a segment of a circle, or a segment of a lateral surface of a cylinder, of approximately 90°. The intermediate conveyor 120 comprises cooperating belts 124, 126, 127, which are guided over various deflecting rollers 125, 128 so as to form the curved conveying gap 122. The belt 124 provided here is a relatively wide one, the deflecting rollers 125 of which are arranged such that the belt forms the convex conveying surface 122*a* of the conveying gap 122. The concave conveying surface 122*b* located opposite is realized here by two parallel belts 126, 127, which are guided over three deflecting rollers 128 and are curved by interaction with the convex conveying surface 122*a*. The extent of the conveying gap 122 can, thus, be adapted to the thickness of the articles 1. At the entrance end of the conveying gap 122, the belts 124, 126, 127 form a pulling-in gap 123. The latter has an opening running transversely to the conveying direction F2 and tapers in the conveying direction F2. The articles 1 always run through the conveying gap 122 such that their surface normal N2 is located perpendicularly to the current conveying direction.

The accelerating element 130 pushes articles which are located in the inlet gap 103 against the belt 124, which forms the convex conveying surface 122*a* of the conveying gap 122. For this purpose, the accelerating element 130 is arranged between the two parallel belts forming the concave conveying surface 122. It is rotated such that its active surface 133, that is to say the surface which is spaced apart furthest from the spindle 134, has the same speed as the belt 124. Moreover, the accelerating element 130 moves in coordination with the cyclic timing in the ingoing formation S1, and therefore it always accesses the same region of the article 1 (in particular a region in which there is no overlap with the following articles). In this way, the articles 1, in this case in the region of their folded edge 2, are clamped against the belt 124, pulled downward out of the inlet gap 103 and separated in the process. Further movement in the first conveying direction F1 is, thus, prevented without the articles 1 having to run against a stop. In order to ensure sufficient clamping and conveying action of the accelerating element 130, a supporting roller 136, which can be rotated about a vertical spindle 138, is arranged, in the present case, within the region enclosed by the belt 124, this supporting roller stabilizing the belt 124 from the inside at the location where the accelerating element 130 pushes against the belt 124 from the outside. The supporting roller 136 may be inherently elastic and/or consist of an elastic material.

The articles 1 are gripped centrally, and introduced into the pulling-in gap 123, by the accelerating element 130. In this gap, they are pushed by the lateral belts 126, 127 against the belt 124 located opposite and are thus conveyed further in the downward direction, and along the curved conveying path, uniformly from both sides. The symmetrical configuration means that the articles 1, rather than being rotated when they are pulled into the conveying gap 122, run through the latter in a highly precise position. The articles run through the conveying gap 122 here with the folded edge 2 leading.

The conveying speed of the intermediate conveyor 120 is selected here such that the articles 1 are separated from the ingoing imbricated formation S1 and run through the intermediate conveyor 120 in a conveying stream S2 of spaced-apart articles. Depending on the ingoing formation S1 and the desired outgoing formation S3, it is also possible to dispense with full separation of the articles.

The exit conveyor 310 follows the exit 140 of the deflecting apparatus 100. In the present case, it is a belt conveyor 312, on which the articles 1 are set down and conveyed further in a lying-down state in the same conveying direction F3 as at the exit 140. Adaptation of the conveying speed of the belt conveyor 312 makes it possible to adjust the spacing between the leading edges, in this case the folded edges 2. In the present case, the belt conveyor 312 conveys at a lower speed than the intermediate conveyor 120, and therefore the outgoing conveying stream S3 on the conveying belt is in imbricated formation.

In order to improve the positioning of the articles as they are set down on the belt conveyor 312, a positioning device 320 is arranged directly at the exit 140. This positioning device comprises two stationary brush strips 322, which are oriented in the conveying direction F3 and prevent the articles 1 from springing away in the upward and forward directions. Also present is a driven positioning element 324, which acts on the articles 1, in the region of the trailing edges thereof, with cyclic timing and causes the same to move downward. It is thus ensured, even at high processing speeds, that the leading edge of one article 1 can always be pushed over the trailing edge of the previously set-down article. The positioning element 324 here is designed as a segment plate which can be rotated about a vertical spindle 325.

The segment plate 112, which narrows the entrance gap 103, and also the accelerating element 130 and the positioning element 324 act on the articles 1 with cyclic timing. For this purpose, they are subjected to common cyclic timing, e.g. by a common drive or by drives which are coupled to one another or by suitable control means. The cyclic timing is generated on the entrance side, e.g. by cyclically timed feeding of the products to the entrance conveyor or to the folding station, or picked up, e.g. by means of suitable sensors.

In order to monitor and control these processes, use is made preferably of a common control device.

Figure 7:
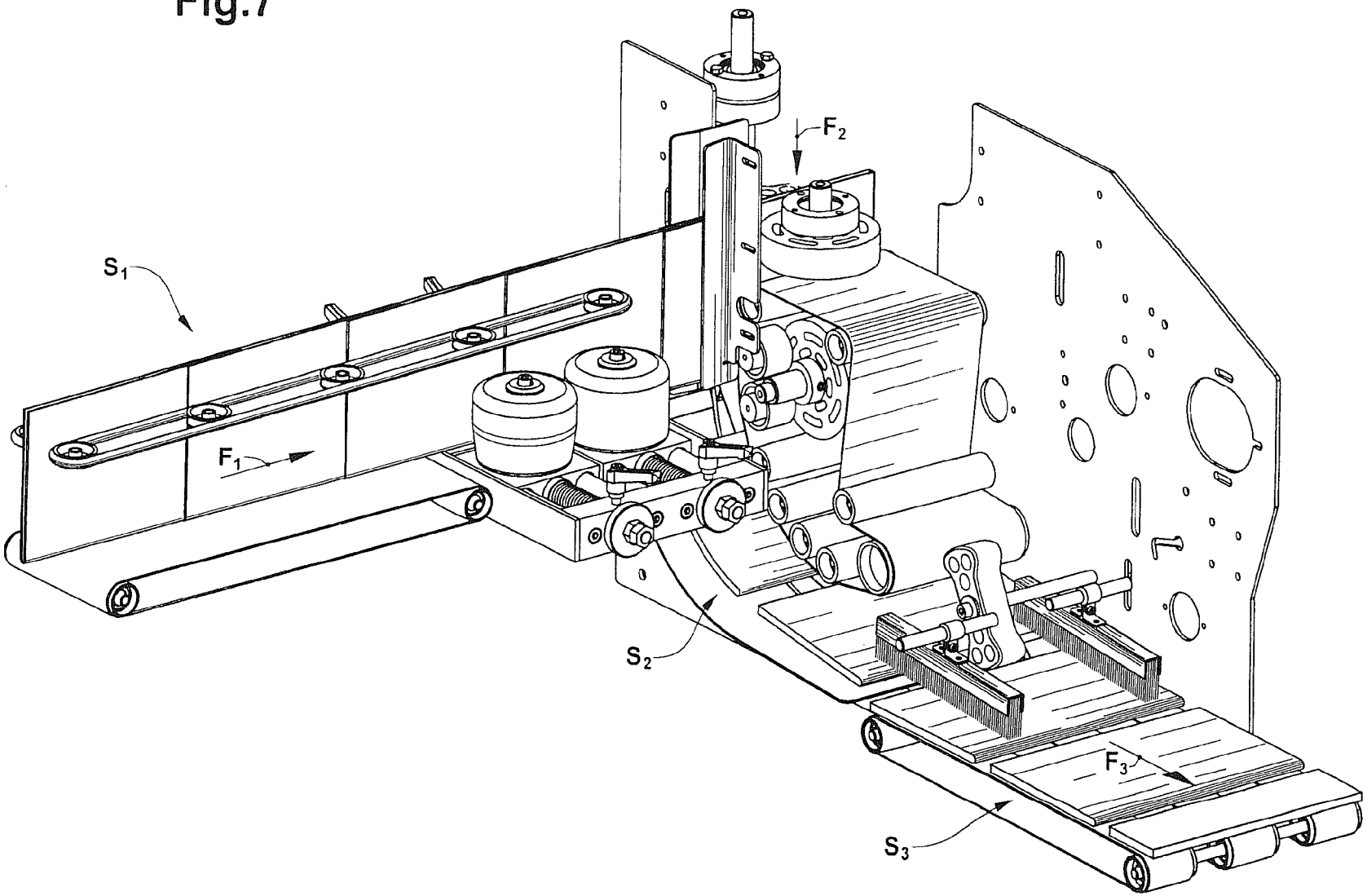
FIGS. 7+8 show the apparatus from FIGS. 1+2 during the production of an outgoing conveying stream which comprises individual articles.

FIG. 7 shows how an outgoing formation S3 of individual articles 1 can be generated using the apparatus from FIGS. 3-6. For this purpose, all that is required is for the conveying speed of the exit conveyor 310 to be adjusted.

Figure 8:
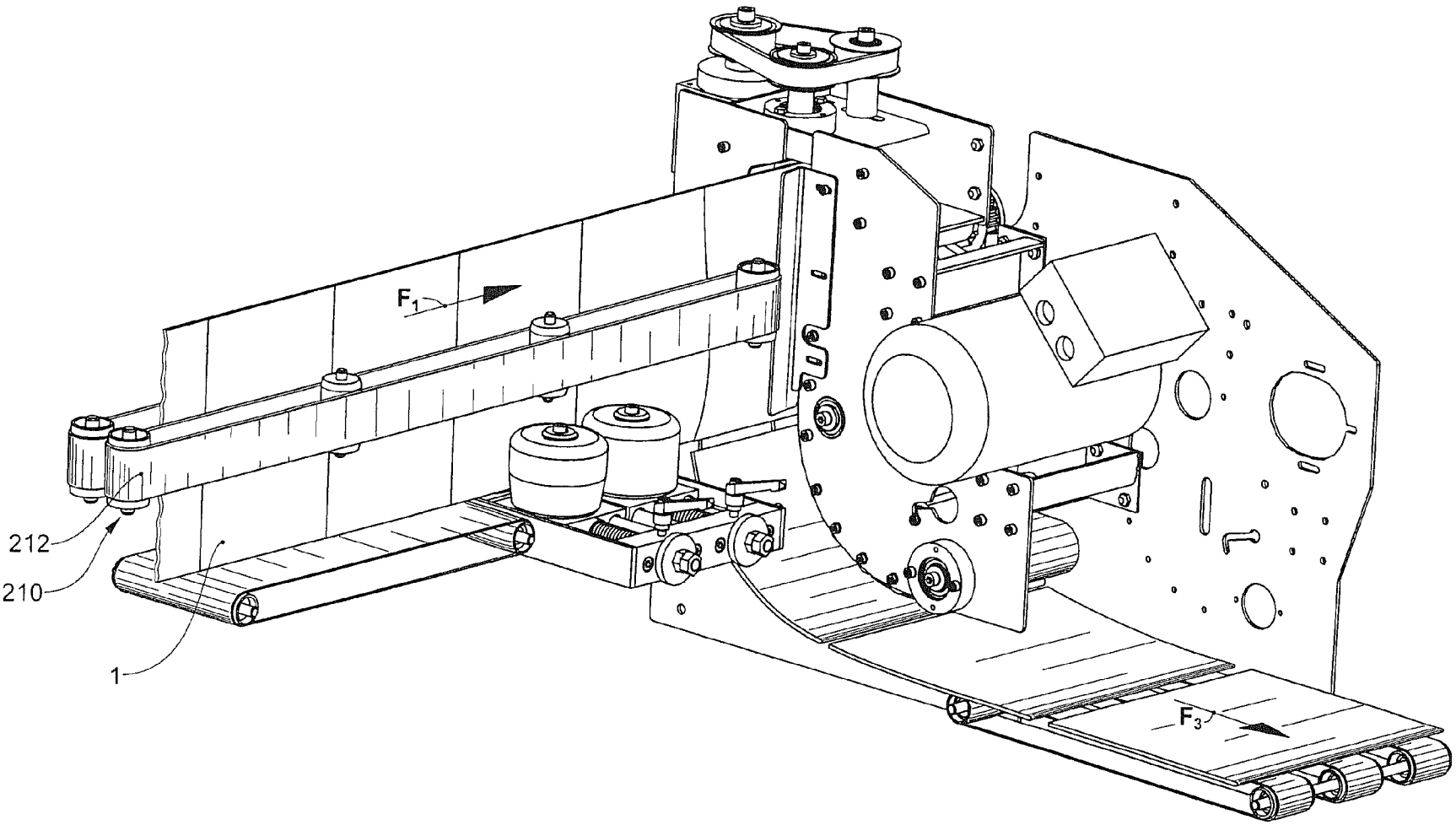

FIG. 8 shows a variant of the apparatus from FIGS. 3-7. The belts 212 of the entrance conveyor 210 are widened in relation to FIGS. 3-7 and are therefore also able to guide relatively wide articles reliably in the direction transverse to the conveying direction F1. The conveying speed of the exit conveyor 310 is selected, as in FIG. 7, such that the articles 1 are conveyed away in a separated state by the exit conveyor 310.

Figure 9:
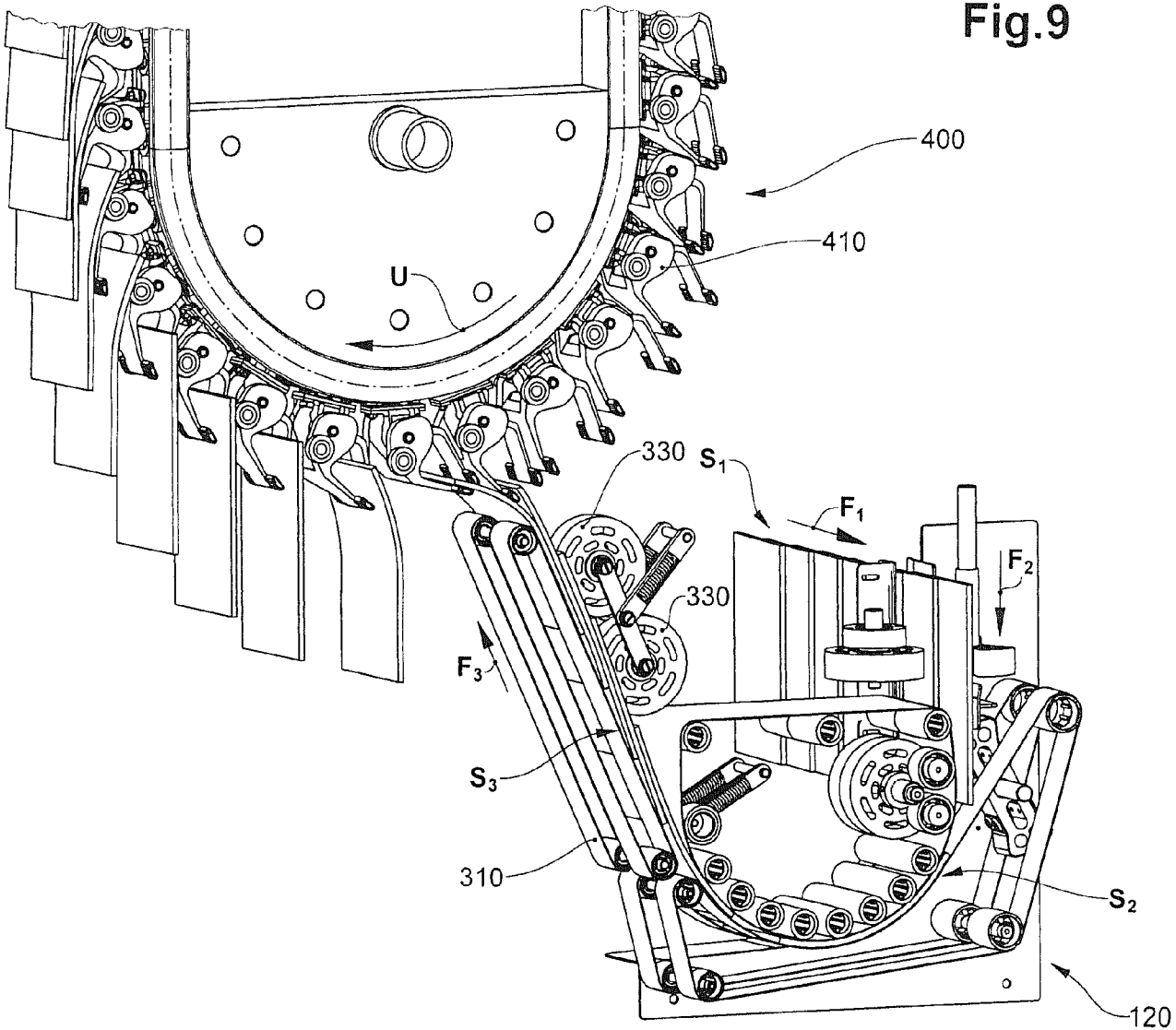
FIG. 9 shows a variant in which the exit conveyor is followed by a gripper conveyor.

FIG. 9 shows a further variant of the apparatus from FIGS. 3-7. The intermediate conveyor 120 rotates the conveying stream S2 through virtually 180° from an initially vertically downwardly running conveying direction F2 into a third conveying direction F3, which runs obliquely upward at a small angle to the vertical. The exit conveyor 310 thus projects obliquely upward. A gripper conveyor 400 with a plurality of grippers 410, which are moved along a closed circulatory path U, is located above the exit conveyor 310. The circulatory path U has its lowermost point above the end of the exit conveyor 310. Here, the open grippers 410 are closed and can receive individually the articles 1 coming from the exit conveyor 310. Depending on control set-up, it is also possible for the grippers 410 to receive groups of articles 1.

In order that the articles 1 in the ascending region of the exit conveyor 310 do not fall downward, they are pushed against the belt of the exit conveyor 310 by two pressure-exerting rollers 330. As an alternative, it is also possible for the exit conveyor 310 to comprise two belts which circulate in opposite directions and between which a conveying gap is formed.

It is, of course, the case that suitable guidance of the belts of the intermediate conveyor 120 makes it possible to realize any other desired angles between the conveying directions F2 and F3. However, the conveying directions F2 and F3 are always located in a plane which runs perpendicularly to the original conveying direction F1.

The invention claimed is:

1. A method by means of which flexible, sheet-like articles, in particular printed products, which are conveyed continuously in a conveying stream are shifted relative to the conveying direction of the conveying stream, comprising the following steps:

conveying the articles in an ingoing conveying stream as an imbricated stream of articles located one upon the other or one inside the other, or a stream of spaced-apart individual articles in a first conveying direction, and with a first orientation of the surface normals thereof, and with predetermined cyclic timing to a deflecting region, terminating the conveying action of the individual articles of the ingoing conveying stream in the first conveying direction by an accelerating element, which acts on the articles with predetermined cyclic timing in the deflecting region and accelerating and deflecting individual articles in a second conveying direction, which is directed perpendicularly to the first conveying direction and perpendicularly to the first orientation of the surface normals in the ingoing conveying stream, by the accelerating element, deflecting the conveying stream, moving in the second conveying direction, in the deflecting region, into a third conveying direction, which is perpendicular to the first conveying direction and encloses an angle other than zero with the second conveying direction, and conveying the articles further, after leaving the deflecting region, in an outgoing conveying stream;

wherein the surface normals of the articles at any point in time are oriented essentially perpendicularly to the current conveying direction.

2. The method as claimed in claim 1, wherein the ingoing conveying stream is an imbricated stream of articles located one upon the other or one inside the other, or a stream of spaced-apart individual articles.

3. The method as claimed in claim 1, wherein the ingoing conveying stream is an imbricated stream in which a leading edge of one article rests on a first side of the respectively preceding article, and the outgoing conveying stream is an imbricated stream in which likewise a leading edge of one article rests on a first side of the respectively preceding article, wherein the articles are optionally separated in the deflecting region.

4. The method as claimed in claim 1, wherein the ingoing conveying stream is an imbricated stream in which a leading edge of one article rests on a first side of the respectively preceding article, and the outgoing conveying stream is an imbricated stream in which a leading edge of one article rests on a second side of the respectively preceding article, wherein the articles are separated in the deflecting region.

5. The method as claimed in claim 1, wherein the articles from the ingoing conveying stream are separated by the accelerating element and run through the deflecting region as a stream of spaced-apart articles.

6. The method as claimed in claim 1, wherein the outgoing conveying stream is an imbricated stream or a stream of spaced-apart individual articles.

7. The method as claimed in claim 1, wherein the articles are deflected in the deflecting region through at least 45°.

8. An apparatus by means of which flexible, sheet-like articles, in particular printed products, which are conveyed continuously in a conveying stream are shifted relative to the conveying direction of the conveying stream, comprising:

an entrance, at which a conveying stream which goes in cyclically timed fashion is fed as an imbricated stream of articles located one upon the other or one inside the other, or a stream of spaced-apart individual articles in a first conveying direction, and with an orientation of the surface normals of the articles perpendicular to the first conveying direction;

at least one accelerating element, which is able to act on the individual articles of the incoming conveying stream with predetermined cyclic timing and thus is able:

to terminate the conveying of the articles in the first conveying direction and to deflect and to accelerate the articles in a second conveying direction, wherein the second conveying direction is directed perpendicularly to the first conveying direction and to the orientation of the surface normals in the ingoing conveying stream;

an intermediate conveyor, which is able to receive, and convey further, the articles following, or during, deflecting and acceleration by the accelerating element, an exit, at which an outgoing conveying stream is discharged, wherein the intermediate conveyor defines a curved conveying path for the articles which is oriented on the entrance side in the second conveying direction and on the exit side in a third conveying direction, which is perpendicular to the first conveying direction and encloses an angle other than zero with the second conveying direction.

9. The apparatus as claimed in claim 8, wherein the accelerating element interrupts the movement of the articles in the first conveying direction, without these articles running against a stop.

10. The apparatus as claimed in claim 8, wherein the intermediate conveyor comprises at least two conveying belts which cooperate with one another, are driven in opposite directions, are guided over deflecting means and between which a curved conveying gap is formed.

11. The apparatus as claimed in claim 10, wherein the accelerating element is able to push an article against one of the conveying belts and thus introduce the article into the conveying gap.

12. The apparatus as claimed in claim 8, further comprising an entrance conveyor, which is positioned upstream of the entrance and is able to feed the ingoing conveying stream to the entrance in the first conveying direction, and with an orientation of the surface normals of the articles perpendicular to the first conveying direction.

13. The apparatus as claimed in claim 8, further comprising an exit conveyor, which is positioned downstream of the exit and is able to receive the outgoing conveying stream and convey it further.

14. The apparatus as claimed in claim 13, further comprising at least one positioning element, which is arranged at the exit and is able to act on the articles with predetermined cyclic timing, in order to assist positioning on the exit conveyor.

15. The apparatus as claimed in claim 8, further comprising guide elements, which are arranged at the entrance and are able to retain the articles in a position which corresponds to the position in the ingoing conveying stream.

16. The apparatus as claimed in claim 14, wherein at least one of the guide elements can be driven synchronously with the accelerating element with such cyclic timing that an article is released by the guide elements as soon as the accelerating element acts on this article.

17. The apparatus as claimed in claim 8, further comprising a folding station, which is arranged immediately upstream of the entrance.

18. The apparatus as claimed in claim 8, wherein the angle between the second conveying direction and the third conveying direction is at least 45°.

* * * * *